United States Patent [19]

Melford et al.

[11] Patent Number: 4,470,448

[45] Date of Patent: Sep. 11, 1984

[54] ELECTROMAGNETIC STIRRING

[75] Inventors: David A. Melford, Saffron Walden; Keith R. Whittington, Great Shelford, both of England

[73] Assignee: TI (Group Services) Limited, Birmingham, England

[21] Appl. No.: 533,633

[22] Filed: Sep. 20, 1983

Related U.S. Application Data

[63] Continuation of Ser. No. 268,820, Jun. 1, 1981, abandoned.

[30] Foreign Application Priority Data

Jun. 5, 1980 [GB] United Kingdom ..... 8018372

[51] Int. Cl.[3] ..... B22D 27/02

[52] U.S. Cl. ..... 164/504; 164/468

[58] Field of Search ..... 164/468, 504, 499, 147.1; 266/233, 234

[56] References Cited

U.S. PATENT DOCUMENTS 2,861,302 11/1958 Mann et al. ..... 164/504
4,200,141 4/1980 Delassus ..... 164/504

FOREIGN PATENT DOCUMENTS 52-34007 9/1977 Japan ..... 164/468
55-40004 3/1980 Japan ..... 164/468
55-54245 4/1980 Japan ..... 164/504

*Primary Examiner*—Kuang Y. Lin
*Attorney, Agent, or Firm*—Kemon & Estabrook

[57] ABSTRACT

An apparatus for stirring a molten metal in an open topped mould, in for example a continuous casting process, includes means positioned above the mould for producing a magnetic field which moves linearly and penetrates down into the mould. The magnetic field may be produced by a series of electrical conductors positioned above the mould and arranged parallel to one another, each of these conductors being connected to a different phase of a multiphase alternating current supply. Ferromagnetic pole pieces may be associated with the conductors to provide a low reluctance flux path, which will reduce leakage of the magnetic field above the conductors and concentrate the field below the conductors where it penetrates down into the mould.

12 Claims, 2 Drawing Figures

ELECTROMAGNETIC STIRRING

Figure 1:
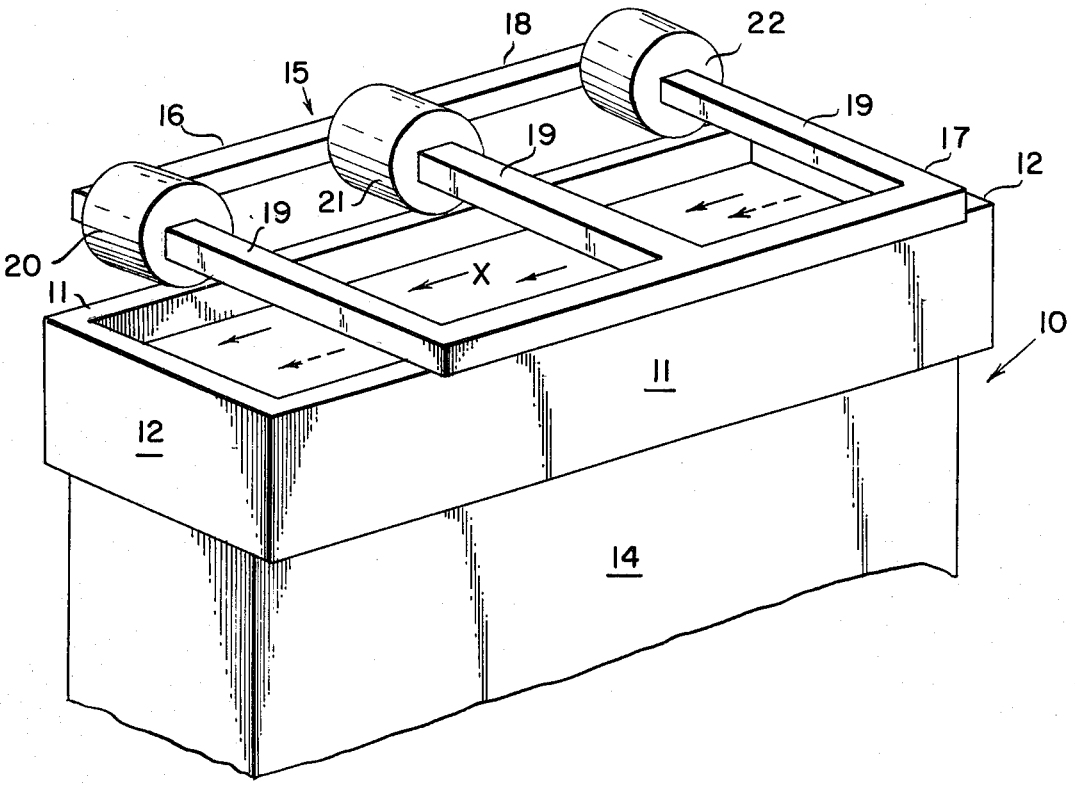

This application is a continuation of application Ser. No. 268,820, filed June 1, 1981, abandoned.

This invention relates to the stirring of molten metals.

When casting metals, for example steel by a continuous casting process, molten steel is poured into a water-cooled copper mould which defines the cross-sectional shape of the section to be cast which then emerges from the bottom of the mould as a continuous strand. As the molten steel contacts the mould, it solidifies to form a skin which gradually thickens as the strand passes through the mould, until at the lower end of the mould, a wall has been built up of sufficient thickness to contain the core of the strand which is still molten. After the strand leaves the mould it is normally further cooled by jets of water, so that the core gradually cools and solidifies from its outer surface, until the whole of the strand has solidified.

If the steel is allowed to solidify under normal conditions, an inhomogeneous structure is formed in which impurities are distributed non-randomly throughout the strand and also the crystal structure of the strand varies between the outer regions, which during the solidification process are subject to high tamperature gradients, and the inner regions which are subjected to relatively low temperature gradients.

In order to obtain a homogeneous structure, it is desirable to agitate the molten metal throughout the casting process. It is known to stir the molten metal in tha core of the strand, by means of electromagnetic transducers placed around the strand as it emerges from the mould. However in general, thesa methods do not adequately stir the metal in the region of the mould and sections produced in this manner have a discontinuity, sometimes termed "white-band". It is desirable therefore that some form of stirring is provided in the mould region itself. Attempts have been made to provide such stirring, by placing electromagnetic transducers around the mould. To date however it has proved difficult to achieve adequate stirring within the mould. The main reason for this is the high electrical conductivity of the copper mould, which substantially attenuates the magnetic field, but also difficulties arise in the positioning of the transducers around the mould, as for greatest effect they must be placed within the water cooling jacket of the mould.

According to one aspect of the present invention, an apparatus for stirring a molten metal in an open topped mould includes means positioned above the mould for producing a linear moving magnetic field which penetrates down into the mould.

The magnetic field produced in this apparatus induces eddy-currents in the molten metal contained within the mould and the fields produced by the eddy-currents intaract with the moving magnetic field and causes the molten metal in the upper part of the mould to move linearly, in planes parallel or substantially parallel to the surface of the molten metal in the mould. The motion induced in the molten metal in the upper part of the mould is conveniently parallel to opposed walls of the mould. The molten metal on reaching the end of the mould moves downwardly; it then flows in the direction opposita to the induced motion, in the lower part of the mould; and then back up the other end wall; thereby circulating throughout the mould. This form of stirrer is particularly suitable for elongated rectangular moulds, such as those used in the continuous casting of aluminium.

According to a preferred aspect of the present invention the means for producing the varing magnetic fields is an electromagnetic transducer. This electromagnetic transducer may be conveniently formed from a series of electrical conductors, which are capable of carrying a high current, these conductors being arranged parallel or substantially parallel to one another and spaced above the open top of the mould, each of the conductors being connected to a different phase of a multiphase alternating current supply, the sequence of the conductors being the same as the saquence of the phases.

Preferably the electrical conductors are made from nonferromagnetic electrically conductive matarials, for example copper, in the form of closed loops. High currents are induced in these loops by means of energising coils which may either be wound about the conductor, or may be coupled thereto by ferromagnetic cores. In a preferred embodiment, a series of closad loops are arranged parallel to one another, these loops being arranged so that each loop lies in a plane which is parallel or substantially parallel to the surface of the molten metal in the mould. These loops may either be individual or may be inter-connected in the form of a ladder.

As the magnetic field produced by the transducer penetrates into the molten metal in the mould through the open top of the mould and not through the walls of the mould there is comparatively little attenuation of the magnetic field and normal mains frequencies of 50 to 60 Hz may consequently be used rather than the lower frequencies which have been found necessary with stirrers positioned around the mould. Typically, the electromagnetic transducer will be designed so that when the energising coils are each connected to a different phase of a three-phase alternating current mains supply, a current in excess of 10,000 amps at a voltage drop of one or two volts and frequency of 50 to 60 Hz will be induced in the conductors.

The strength of the magnetic field induced by the electrical conductors, which penetrates the mould, may be enhanced by providing ferromagnetic pole pieces. These pole pieces are arranged so as to provide a low reluctance path for the magnetic field over the top of the conductors, while retaining a relatively high reluctance path below the conductors, so that leakage of the magnetic field above the mould will be reduced and the field concentrated below the conductors, where it penetrates into the mould.

Figure 2:
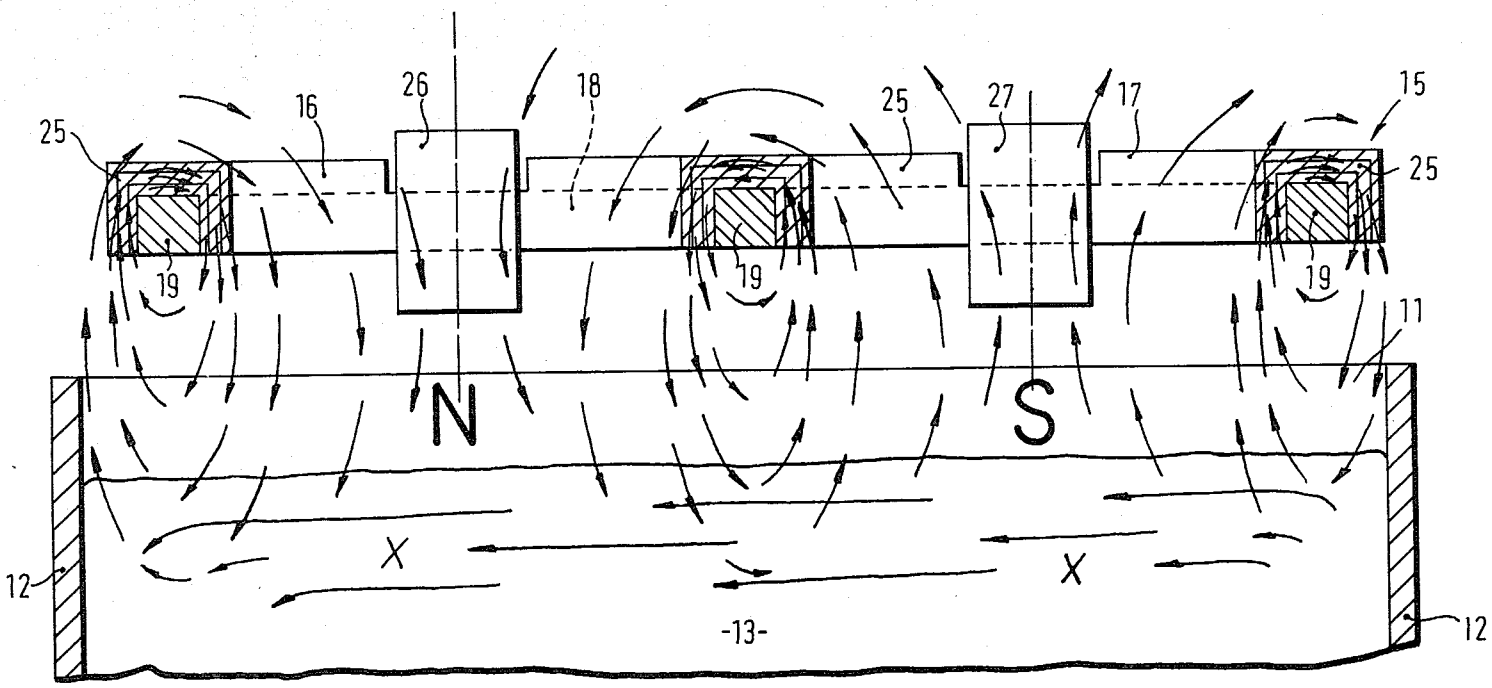

Various embodiments of the present invention are now described, by way of example only, with reference to the accompanying drawings, in which:

FIG. 1 illustrates a continuous casting apparatus incorporating an electromagnatic stirrer in accordance with the present invention; and FIG. 2 shows a part sectional view of a modification of the stirrer shown in FIG. 1.

As illuatrated in FIG. 1, an apparatus for the continuous casting of aluminium comprises a ractangular copper mould 10, defined by a pair of longitudinal walls 11 and a pair of end walls 12. Molten aluminium 13 is poured into the top of the mould 10 where it solidifies on contact with the walls 11, 12 of the mould 10 to form a skin, which gradually increases in thickness as it passes through the mould 10, until at the lower end of the mould it emerges as a continuous strand 14. As it emerges from the bottom of the mould 10, the strand 14 is only partially solidified, but the skin is of sufficient thickness to retain the molten core which rapidly solidifies to eventually form a solid strand.

An electromagnetic transducer 15 is spaced above the open top of the copper mould 10. This transducer 15 is formed from stout copper bars 18, 19 and is in the form of a pair of closed loops 16 and 17, defined by a pair of bars 18, which are parallel to the longitudinal walls 11 of ihe mould 10 and three cross bars 19, which are parallel to the end walls 12 of the mould 10. The transducer 15 is positioned parallel to the top of the mould 10, so that the plane of the loops 16 and 17 is substantially parallel to the surface of the molten aluminium 13 in the mould 10.

Toroidal energizing coils 20, 21 and 22 are wound about the three cross bars 19 and ara connected each to a different phase of a three-phase alternating current supply, the sequence of the coils 20, 21 and 22 being the same as the sequence of the phases. In this manner the currents passing through coils 20 and 21 will induce a current in closed loop 16 and the currents passing through coils 21 and 22 will induce a current in the closed loop 17. The energising coils 20, 21 and 22 are such that the alternating mains supply will induce a current of the order of 12,000 amps at a voltage drop of the order of one volt in the loops 16 and 17.

Considering a specific point in the three-phase mains cycle, the current induced in loop 16 will create a magnetic field which is directed downwards through the loop 16 and the current induced in loop 17, which is in the opposite direction to that in loop 16, will create a magnetic field which will be directed upwardly through loop 17. Loop 16 will consequently form a North pole below the loop and loop 17 will form a South pole below the loop. As the mains cycle progresses, the currents in loops 16 and 17 reverse, and so the pole beneath loop 16 changes from North to South and that beneath loop 17 changes from South to North, and so on. The transducer 15 thus produces what is effectively a linear moving magnetic field.

The varying magnetic fields produced by loops 16 and 17 induce eddy-currents in the surface layer of molten aluminium 13 in the mould 10, and these eddy-currents in turn create magnetic fields. Interaction of the magnetic fields created by the eddy-currents and the magnetic field formed by the transducer 15, causes the molten aluminium 13 to move along with the magnetic field formed by the transducer 15, in the direction of arrows X, thus causing the molten alumimium 13 to circulate in the mould 10.

The electromagnetic transducer 15 described above, produces equal and opposite magnetic fields above and below each of the loops 16 and 17. As it is only the fields below the loops 16 and 17 that induce movement of the molten aluminium 13, the overall efficiency of this stirrer is limited. The efficiency of the stirrer may be substantially increased by the incorporation of ferromagnetic pole pieces, as illustrated in FIG. 2.

In FIG. 2, the copper bars 18 and 19 are surrounded by ferromagnetic pole pieces 25, these pole pieces 25 ara of inverted channel section which overlie the upper and side edges of the bars 18, 19. These pole pieces 25 form a low reluctance path to the magnetic fialds formed by the currents flowing through loops 16 and 17 and thus substantially reduce the amount of leakage of the magnetic field above the transducer 15 and concentrate it below the transducer 15, as illustrated in FIG. 2. Advantageously the ferromagnetic pole piece 25 may be of multi-ply construction. Where multi-ply pole pieces are used, the exposed ends of the plies are conveniently covered by a sheet of non-magnetic material, such as stainless steel, in order to avoid damage from splashes of molten metal 13, from the mould.

Also in the embodiment illustrated in FIG. 2, a two-phase alternating current supply is used, each loop 16 and 17 having only one toroidal energising coil 26, 27 which is wound about one of the longitudinal bars 18.

Clearly, it is convenient to use a three-phase alternating current mains supply. However, as illustrated in FIG. 2 any multi-phase supply may be used to suit the number of closed loops in the transducer. The number of closed loops used will depend on the dimensions of the mould, it being necessary in most applications to leave relatively unhindered access io the top of the mould. A double loop arrangement as illustrated in FIG. 1 or an arrangement with a multiple of three loops with a single energising coil per loop, would be most suitable for use with a three-phase alternating current mains supply.

In the embodiments described above the energising coils 20, 21, 22, 26 and 27 are wound about the copper bars 18, 19. These bars are however, heated by the radient heat from the molten metal and also by the high currents flowing through the bars 18, 19 and there is consequently a danger that the energising coils 20, 21, 22, 26 and 27 may be damaged by excessive heat. One way of avoiding damage to the energising coils 20, 21, 22, 26 and 27 is to cool either the copper bars 18, 19, or the energising coils 20, 21, 22, 26 and 27 themselves. One method of doing this is to provide ducts in the copper bars 18, 19 through which a coolant, for example water, may be circulated.

While stirrers of the type disclosed are particularly suitable for use with elongated rectangular moulds such as those commonly used in the continuous casting of aluminium, they may be used for moulds of different shapes and for the stirring of other molten metals. The stirrers may also be used in other forms of open topped moulds, for example ingot moulds. Furthermore while the transducers described above are particularly useful for stirring molten metals in open containers with walls formed from materials of high electrical conduotivity which would significantly attenuate the penetration of a magnetic field into the container, they may also be used to stir molten metals in open or closed containers made of materials of low or non-electrical conductivity.

Various modifications may be made to the embodiments described above without departing from the invention. For example, in any of the embodiments where the energising coils are described as being wound about the copper conductors, it is necessary to provide adequate insulation and also the coils are preferably wound onto an appropriately shaped ferromagnetic core.

We claim:

1. An apparatus for stirring molten metal in an open topped mold comprising: a plurality of conductors in the form of closed loops made from bars of non-ferromagnetic electrically conductive material, each loop being disposed horizontally or substantially horizontally and in line with the other loops above the open top of the mold, each of the loops being coupled inductively via an energizing coil to a different phase of a multiphase alternating current supply, the sequence of the loops being the same as the sequence of the phases, such that the currents passing through the loops produce a linear moving magnetic field which penetrates down into the mold.

2. An apparatus as set forth in claim 1, in which ferromagnetic pole pieces are associated with the conductors, said ferromagnetic pole pieces being positions to reduce leakage of the magnetic field above the transducer and concentrate the field below the transducer.

3. An apparatus as in claim 1 in which the closed loops are interconnected in the form of a ladder.

4. An apparatus as in claim 1 in which the electrical conductors are made of copper.

5. An apparatus as in claim 2 in which the ferromagnetic pole pieces are of inverted channel section and overlie the upper and side edges of the non-ferromagnetic electrically conductive bars.

6. An apparatus as in claim 2 in which the ferromagnetic pole pieces are of multi-ply construction.

7. An apparatus as in claim 6 in which the exposed lower longitudinal edges of the plies are covered with a sheet of non-ferromagnetic material.

8. An apparatus as in claim 1 in which the electrical conductors are provided with ducts through which a coolant may be circulatad.

9. An apparatus as in claim 1 in which each energising coil is wound around its associated electrical conductor.

10. An apparatus as in claim 1 in which the transducer is energised by a multi-phase alternating current supply having a frequency of from 50 to 60 Hz.

11. An apparatus as in claim 1 in which the current in the conductors is at least 10,000 amps at a voltage drop of about 1 or 2 volts.

12. A continuous casting apparatus wherein the improvement comprises a mould and a stirrer as claimed in claim 1, said stirrer being positioned above the mould and being arranged to produce a linear moving magnetic field which penetrates into the mould.

* * * * *